US005885348A

United States Patent [19]

Spatafora

[11] Patent Number: 5,885,348

[45] Date of Patent: Mar. 23, 1999

[54] GUMMING DEVICE

[75] Inventor: Mario Spatafora, Bologna, Italy

[73] Assignee: Azionaria Costruzioni Macchine Automatiche A.C.M.A. S.p.A., Bologna, Italy

[21] Appl. No.: 728,137

[22] Filed: Sep. 6, 1996

[30] Foreign Application Priority Data

Sep. 8, 1995 [IT] Italy ..... B095A0419

[51] Int. Cl.[6] ..... B05C 1/08; B05C 9/20

[52] U.S. Cl. ..... 118/261; 118/258; 156/578

[58] Field of Search ..... 156/578; 118/261, 118/203, 258

[56] References Cited

U.S. PATENT DOCUMENTS

| | | | |
|---|---|---|---|
| 596,966 | 1/1898 | Frambach | 118/261 |
| 1,993,055 | 3/1935 | Gerstenberg | 118/261 |
| 2,467,998 | 4/1949 | Stefanelli | 118/261 |
| 2,615,422 | 10/1952 | Ackley | 118/261 |
| 3,991,708 | 11/1976 | Huebschmann et al. . | |
| 3,996,890 | 12/1976 | Werner et al. . | |
| 4,685,417 | 8/1987 | Kronseder | 118/261 |

FOREIGN PATENT DOCUMENTS 0 534 664 3/1993 European Pat. Off. .

*Primary Examiner*—Jeff H. Aftergut
*Attorney, Agent, or Firm*—Oblon, Spivak, McClelland, Maier & Neustadt, P.C.

[57] ABSTRACT

A gumming device wherein a gumming roller is fitted in rotary manner to a frame so as to rotate about its own longitudinal axis, and presents a substantially cylindrical outer surface for receiving an adhesive substance; a scraper element is positioned substantially contacting the outer surface and downstream, in a traveling direction of the outer surface, from a device for supplying the adhesive substance, to remove the adhesive substance from the outer surface; and the scraper element is guided in a direction crosswise to the longitudinal axis of the gumming roller by a guide device, and is moved along the guide device by an elastic push device for automatically taking up any slack between the scraper element and the outer surface of the gumming roller.

13 Claims, 2 Drawing Sheets

GUMMING DEVICE

BACKGROUND OF THE INVENTION

1. Field of the Invention

The present invention relates to a gumming device.

More specifically, the present invention relates to a gumming device of the type comprising a frame; a gumming roller fitted to the frame to rotate about its own longitudinal axis, and presenting a substantially cylindrical outer surface for receiving an adhesive substance; supply means for feeding the adhesive substance on to said outer surface; and a scraping device comprising a scraper element substantially contacting, and for removing the adhesive substance from, said outer surface.

2. Discussion of the Background

Devices of the above type are described, for example, in U.S. Pat. Nos. 3,991,708, 3,996,890 and EP-A-O 534 664, in which the scraping device is connected directly to a tank or cavity facing and closed by the outer surface of the gumming roller and housing a given quantity of adhesive substance, and the scraping device defines one end of the tank and forms a sealing element, fixed or movable in relation to the tank, between the tank and the outer surface of the gumming roller.

Known gumming devices of the above type, wherein the scraping device substantially forms a portion of the tank, have proved critical at high operating speed, due to vibration of the tank resulting in corresponding vibration of the scraping device and hence in uncontrolled quantities of adhesive substance being emitted from the tank, and due to the scraping device controlling the emission of adhesive substance, as opposed to the quantity of adhesive substance already emitted from the tank. In other words, the scraping device acts as a poorly controllable tap for supplying the adhesive substance from the tank, as opposed to a precision device for controlling the thickness of the adhesive substance already fed on to the outer surface of the gumming roller.

SUMMARY OF THE INVENTION

It is an object of the present invention to perfect known gumming devices of the above type, to eliminate the aforementioned drawback.

It is a further object of the present invention to provide a gumming device of the aforementioned type, wherein the scraping device is so formed as to minimize wear.

According to the present invention, there is provided a gumming device comprising a frame; a gumming roller fitted to the frame so as to rotate about its own longitudinal axis, and presenting a substantially cylindrical outer surface for receiving an adhesive substance; supply means for feeding the adhesive substance onto said outer surface; and a scraping device substantially contacting said outer surface and for removing the adhesive substance from the outer surface; wherein the scraping device is independent of said supply means, is located downstream from said supply means in the traveling direction of said outer surface, and is movable in relation to the gumming roller in a direction crosswise to said axis; guide means being connected to the scraping device to guide it in said crosswise direction; the frame presenting supporting means for supporting the scraping device on the frame; and pushing means being interposed between the supporting means and the scraping device to move the scraping device along said guide means.

Said scraping device preferably comprises a replaceable scraper element, which is positioned directly contacting said outer surface.

BRIEF DESCRIPTION OF THE DRAWINGS

A non-limiting embodiment of the present invention will be described by way of example with reference to the accompanying drawings, in which.

DESCRIPTION OF THE PREFERRED EMBODIMENT

Figure 1:
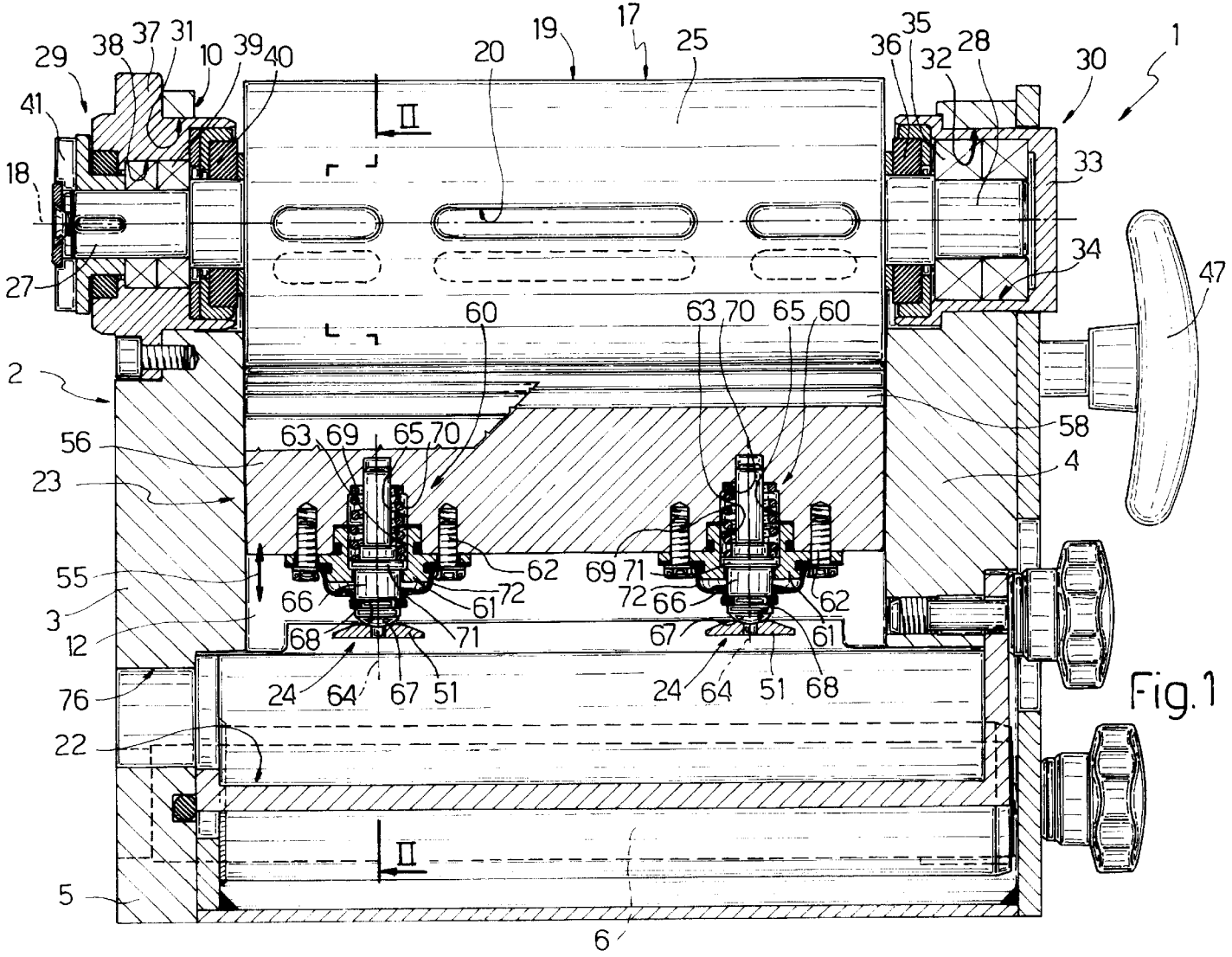
FIG. 1 shows a partially sectioned view, with parts removed for clarity, of a preferred embodiment of the gumming device according to the present invention.
Figure 2:
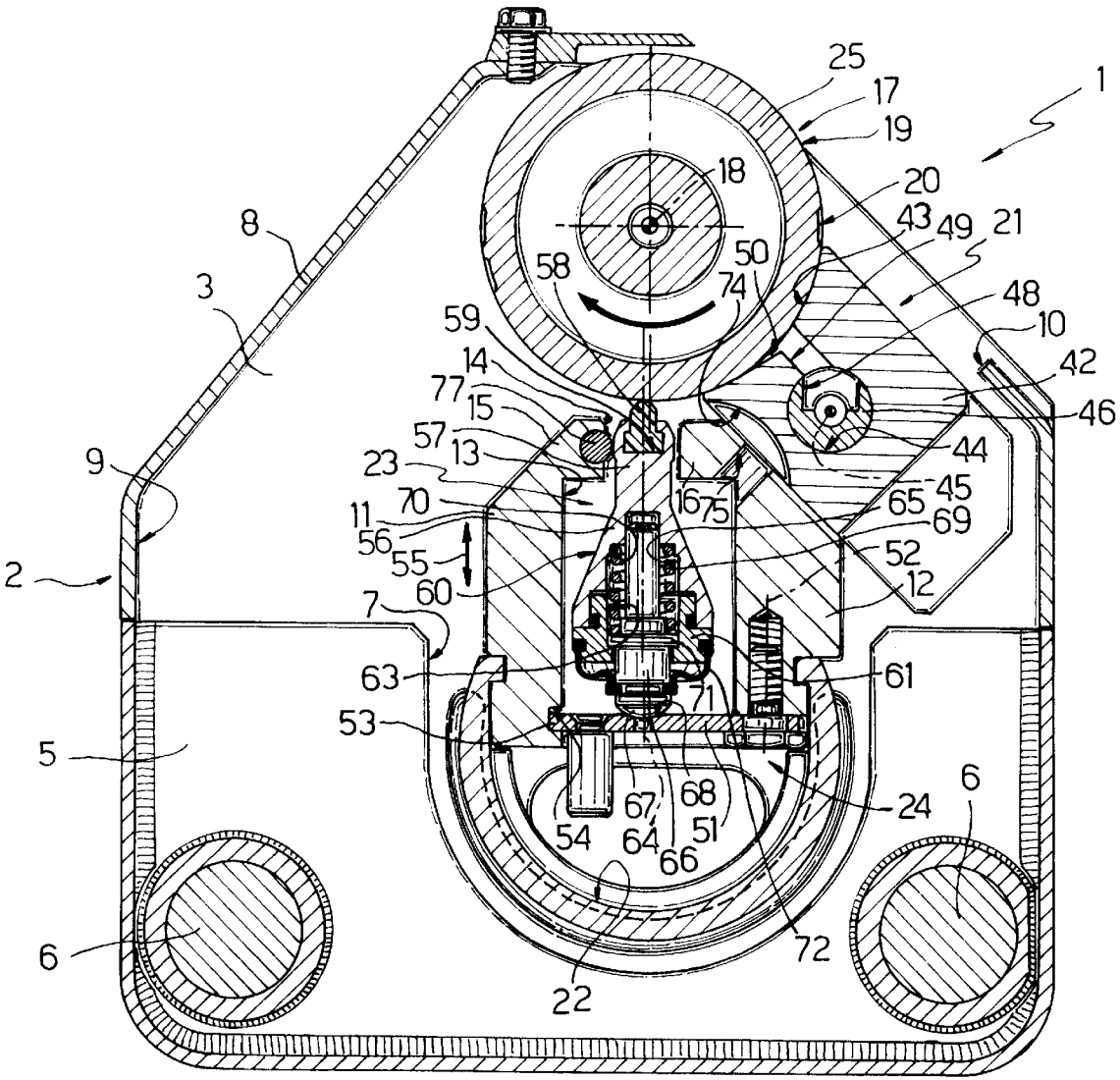
FIG. 2 shows a sectional view taken along line II—II in FIG. 1.

Number 1 in FIGS. 1 and 2 indicates a gumming device comprising a frame 2, which in turn comprises two facing vertical lateral walls 3 and 4, and a sliding box 5 defining a bottom portion of frame 2, and which is fitted so as to move along two cylindrical longitudinal guides 6 extending transversely from wall 3 to wall 4, and presents an open-topped, substantially U-shaped longitudinal recess 7.

Frame 2 also comprises a cup-shaped cover 8 fitted to walls 3 and 4, over box 5, and defining, together with walls 3, 4 and recess 7, a chamber 9 presenting a longitudinal upper opening 10 formed through cover 8. Frame 2 also comprises two inner walls 11 and 12 fitted transversely to walls 3 and 4 and housed partly inside recess 7. Walls 11 and 12 face each other to define, together with walls 3 and 4, a chamber 13 open at the bottom over recess 7, and communicating at the top with chamber 9 via a longitudinal opening 14 defined by two respective free ends 15 and 16 of walls 11 and 12 extending towards each other crosswise to walls 11 and 12.

Device 1 also comprises a cylindrical gumming roller 17 fitted to frame 2, over opening 14, to rotate about is own longitudinal axis 18, and which presents a substantially cylindrical outer surface 19 coaxial with axis 18. Surface 19 partly engages opening 10, and presents a number of cavities 20, each for receiving an adhesive substance from a supply device 21 facing roller 17, and for transferring the adhesive substance onto a respective portion of material (not shown) to be gummed. Device 1 also comprises a tank 22 for collecting said adhesive substance, and which is located inside cavity 7, beneath chamber 13, and fitted movably to walls 11 and 12; and a scraping device 23 held inside chamber 13 by supporting means defined by a supporting device 24 forming part of device 1 and in turn supported by inner wall 12 of frame 2. Gumming roller 17 comprises a substantially cylindrical central body 25 defined externally by surface 19; and two tubular end appendixes 27 and 28 extending coaxially with axis 18 on either side of body 25, and supported for rotation by respective supports 29 and 30 inside respective through holes 31 and 32 formed through respective walls 3 and 4.

Support 30 comprises a tubular bell 33 fixed in known manner inside hole 32 and about appendix 28, and presenting a cavity 34 coaxial with axis 18, facing roller 17, and housing a pair of bearings 35 supporting appendix 28, and a sealing ring 36 contacting a lateral surface of body 25. Support 29 comprises a bush 37 fixed in known manner inside hole 31 and about appendix 27, and presenting a through hole 38 coaxial with axis 18 and housing a pair of bearings 39 supporting appendix 27, and a sealing ring 40 contacting a lateral surface of body 25. Appendix 27 projects laterally outwards in relation to bush 37 to support in an angularly-fixed manner a gear 41 meshing with a known drive assembly (not shown) for driving gumming roller 17.

Device 21 for supplying said adhesive substance comprises a supporting element 42, which is fixed to walls 3 and 4 and contacts wall 12, is defined on the side facing roller 17 by a substantially cylindrical surface 43 coaxial with axis 18 and substantially contacting surface 19 of roller 17, and presents a through hole 44 coaxial with its own axis 45 parallel to axis 18.

Device 21 also comprises a valve 46, which is mounted for rotation inside hole 44 to rotate about axis 45, is angularly integral with a knob 47 outside wall 4, and presents a longitudinal groove 48 communicating at one end with a source (not shown) of said adhesive substance, and selectively connectable at the other end, by rotating knob 47, to a conduit 49 formed inside element 42, crosswise to axis 45, and for feeding the adhesive substance onto surface 19 via a longitudinal opening 50 formed in surface 43.

Supporting device 24 comprises at least two brackets 51 fitted in a rotary manner to inner wall 12 of frame 2 so as to rotate, independently of each other and about respective vertical axes 52, between an operating or clamped position of device 23 (FIG. 2) in which brackets 51 are positioned crosswise to wall 12 and engage, with a respective free end 53, a longitudinal groove 54 formed in wall 11, and an idle or release position of device 23 (not shown) in which brackets 51 are positioned parallel to wall 12 to enable withdrawal of device 23 from chamber 13, after first removing box 5 and tank 22 and clearing said bottom portion of frame 2.

By guide means defined by walls 3 and 4, scraping device 23 is guided laterally in a direction 55 crosswise to axis 18 of gumming roller 17, and comprises a substantially wedge-shaped central body 56 presenting a top end 57 movable through opening 14, and a scraper element 58 made of a wear-resistant and heat-resistant plastic material and partly housed inside a longitudinal groove 59 formed along end 57. Element 58 substantially contacts outer surface 19 of roller 17 to remove the adhesive substance from the outer surface and to even the thickness of the adhesive substance retained, in use, inside cavities 20.

Scraping device 23 also comprises elastic pushing means defined by an elastic pushing device 60 integral with body 56 and interposed between devices 23 and 24 to push device 23 in direction 55 and so maintain element 58 permanently contacting surface 19 in use, to automatically take up any slack due to inevitable wear of element 58, and to ensure correct removal of the adhesive substance from surface 19.

For each bracket 51, elastic pushing device 60 comprises a bush 61 fixed rigidly beneath body 56 by means of a number of screws 62, and presenting a central through hole 63, which is coaxial with an an axis 64 substantially parallel to respective axis 52, and is aligned with a respective hole 65 formed inside body 56. For each bush 61, elastic pushing device 60 also comprises a pin 66 fitted so as to slide inside hole 65 and through hole 63, and which presents a substantially spherical end portion 67 projecting downwards outside hole 63 and housed inside a spherical seat 68 formed on top of respective bracket 51 to permit a small amount of transverse oscillation of body 56 inside chamber 13 and about an axis (not shown) parallel to axis 18, and, hence, a small amount of oscillation of end 57 inside opening 14.

For each pin 66, elastic pushing device 60 also comprises a helical spring 69 wound about pin 66 and compressed between the end surface 70 of hole 65 and a flange 71 of pin 66, which flange 71, in addition to acting as a stop for spring 69, also prevents pin 66 from withdrawing from hole 63. Spring 69 provides for pushing elastic device 60 in direction 55 when portion 67 is seated, in use, inside respective seat 68, as well as for enabling respective bracket 51 to move between said clamped and release positions.

For each bush 61, elastic pushing device 60 also comprises a flexible bell-shaped seal 72, one end of which is fitted by screws 62 to each respective bush 61, and the opposite end of which is fitted to respective pin 66 to isolate holes 63 and 65 in fluidtight manner.

Operation of gumming device 1 will now be described in the steady-state condition, in which gumming roller 17 is rotated clockwise (in FIG. 2) about axis 18 by the drive assembly (not shown), and device 21 feeds the adhesive substance onto outer surface 19 and into cavities 20.

In the above operating condition, device 60 pushes scraper element 58 substantially into contact with surface 19 to remove the adhesive substance from surface 19 and to even the thickness of the adhesive substance in cavities 20; the adhesive substance scraped off surface 19 gradually accumulating on end 16 of wall 12, from where it is fed into chamber 13 via a cavity 74 and a conduit 75 formed respectively in element 42 and wall 12. From chamber 13, the adhesive substance flows into tank 22 to a known collecting device (not shown) communicating with tank 22 via an outlet conduit 76 formed in wall 3. The and the contact between scraper element 58 and outer surface 19 pushes end 57 of central body 56 of the scraper device against a fixed stop 77 housed along end 15, facing opening 14, and which provides for regulating the transverse oscillation of body 56 inside chamber 13.

At the end of the operating cycle, box 5 and tank 22 are removed to enable brackets 51 to be moved manually from the clamped to the release position, and scraping device 23 is removed from chamber 13 for cleaning.

It should be pointed out that elastic push device 60, which, as stated, provides for automatically taking up any slack between scraper element 58 and surface 19 as a result of wear of element 58, also provides for limiting of the maintenance to the cleaning of device 1, in the course of which, it is also possible to replace element 58 by simply removing it from groove 59 in which it is partly housed.

Device 1 therefore provides not only for reducing maintenance to an absolute minimum, but also for ensuring correct performance of the gumming operation at all times.

Obviously, numerous modifications and variations of the present invention are possible in light of the above teachings. It is therefore to be understood that within the scope of the appended claims, the invention may be practiced otherwise than as specifically described herein.

I claim:

1. A gumming device, comprising:

a frame;

a gumming roller fitted to the frame so as to rotate about its own longitudinal axis, and having a substantially cylindrical outer surface receiving an adhesive substance;

a supply source feeding the adhesive substance onto said outer surface;

a scraping device substantially contacting said outer surface and removing the adhesive substance from the outer surface the scraping device being independent of said supply source, being located downstream from said supply source in a traveling direction of said outer surface, being movable in relation to the gumming roller in a direction crosswise to said axis and being fixed to the frame so as to oscillate about a further axis parallel to the axis of the gumming roller;

a guide connected to the scraping device and guiding said scraping device in said crosswise direction, the frame comprising a support supporting the scraping device on the frame; and a pushing mechanism interposed between the support and the scraping device, said pushing mechanism moving the scraping device along said guide.

2. A device as claimed in claim 1, characterized in that wherein said frame comprises two vertical lateral walls facing each other on either side of said scraping device; said guide being defined by said two lateral walls.

3. A device as claimed in claim 1, wherein said pushing mechanism comprises an elastic pushing mechanism.

4. A device as claimed in claim 3, wherein said support comprises at least two brackets fitted to said frame so as to rotate about respective axes; the axis of each said bracket being crosswise to said longitudinal axis of said gumming roller.

5. A device as claimed in claim 1, wherein said support is selectively movable between an operating position, in which the support cooperates with said pushing mechanism and supports said scraping device on the frame, and an idle position in which the support permits removal of the scraping device from the frame.

6. A device as claimed in claim 1, wherein said scraping device comprises a replaceable end scraper element, which is positioned directly contacting said outer surface.

7. A device as claimed in claim 6, wherein said scraper element is housed partially inside a longitudinal end groove of said scraping device.

8. A device as claimed in claim 6, wherein said scraper element comprises a wear-resistant and temperature-resistant plastic material.

9. A device as claimed in claim 1, which comprises a stop interposed between said frame and the scraping device to limit oscillation of the scraping device to limit oscillation of the scraping device about said further axis in said traveling direction of said outer surface.

10. A gumming device, comprising:

a frame;

a gumming roller fitted to the frame so as to be rotatable about a longitudinal axis thereof, and having a substantially cylindrical outer surface receiving an adhesive substance;

a supply source feeding the adhesive substance onto said outer surface;

a scraping device substantially contacting said outer surface and removing the adhesive substance from the outer surface; the scraping device being independent of said supply source, being located downstream from said supply in a traveling direction of said outer surface, and being movable in relation to the gumming roller in a direction crosswise to said axis;

a guide connected to the scraping device to guide the scraping device in said crosswise direction;

the frame comprising a support supporting the scraping device on the frame, said support comprising at least two brackets fitted to said frame so as to rotate about respective axes thereof, the axis of each said bracket being crosswise to said longitudinal axis of said gumming roller; and a pushing mechanism interposed between the support and the scraping device to move the scraping device along said guide.

11. A gumming device, comprising:

a frame;

a gumming roller fitted to the frame so as to be rotatable about a longitudinal axis thereof, and having a substantially cylindrical outer surface receiving an adhesive substance;

a supply source feeding the adhesive substance onto said outer surface;

a scraping device substantially contacting said outer surface and removing the adhesive substance from the outer surface; the scraping device being independent of said supply, being located downstream from said supply in a traveling direction of said outer surface, and being movable in relation to the gumming roller in a direction crosswise to said axis;

a guide connected to the scraping device to guide the scraping device in said crosswise direction;

the frame comprising a support supporting the scraping device on the frame, and two vertical lateral walls facing each other on either side of said scraping device, said guide being defined by said two lateral walls; and a pushing mechanism interposed between the support and the scraping device to move the scraping device along said guide.

12. A gumming device, comprising:

a frame;

a gumming roller fitted to the frame so as to be rotatable about a longitudinal axis thereof, and having a substantially cylindrical outer surface receiving an adhesive substance;

a supply source feeding the adhesive substance onto said outer surface; and a scraping device substantially contacting said outer surface, said scraping device removing the adhesive substance from the outer surface and removing the adhesive substance from the outer surface;

the scraping device being independent of said supply, being located downstream from said supply source in a traveling direction of said outer surface, being movable in relation to the gumming roller in a direction crosswise to said axis, and being fitted to the frame so as to oscillate about a further axis parallel to the axis of the gumming roller.

13. A gumming device, comprising:

a frame;

a gumming roller fitted to the frame so as to be rotatable about a longitudinal axis thereof, and having a substantially cylindrical outer surface receiving an adhesive substance;

a supply source feeding the adhesive substance onto said outer surface; and a scraping device substantially contacting said outer surface and removing the adhesive substance from the outer surface;

the scraping device being independent of said supply source, being located downstream from said supply in a traveling direction of said outer surface, and being fitted to the frame so as to oscillate about a further axis parallel to the axis of the gumming roller.

* * * * *